United States Patent [19]

McDonald

[11] 4,412,128

[45] Oct. 25, 1983

[54] AUTOMATIC BRIGHTNESS CONTROL CIRCUIT FOR A HIGH VOLTAGE ELECTRICAL POWER SUPPLY

[75] Inventor: Richard L. C. McDonald, Mitcham, England

[73] Assignee: U.S. Philips Corporation, New York, N.Y.

[21] Appl. No.: 229,418

[22] Filed: Jan. 29, 1981

[30] Foreign Application Priority Data

Feb. 4, 1980 [GB] United Kingdom ..... 8003613

[51] Int. Cl.[3] ..... H01J 31/50

[52] U.S. Cl. ..... 250/213 VT; 250/207; 315/10

[58] Field of Search ..... 250/213 VT, 207, 213 R, 250/214 R; 315/10, 11, 12 R, 160

[56] References Cited

U.S. PATENT DOCUMENTS

| | | | |
|---|---|---|---|
| 3,694,659 | 9/1972 | Ramsay et al. | 250/213 VT |
| 3,816,744 | 6/1974 | Chow | 250/213 VT |
| 4,044,249 | 8/1977 | Moore, Jr. et al. | 250/213 VT |

FOREIGN PATENT DOCUMENTS 1340092 12/1973 United Kingdom .

*Primary Examiner*—David C. Nelms
*Assistant Examiner*—Edward P. Westin
*Attorney, Agent, or Firm*—Marc D. Schechter

[57] ABSTRACT

A series regulated power supply arrangement for an image intensifier tube, comprises an oscillator circuit, a high voltage multiplier and an automatic brightness control (ABC) circuit. The ABC circuit includes a series regulator for producing a variable voltage to be supplied to the microchannel plate of the image intensifier tube. The series regulator comprises a junction power transistor having a load resistor connected to its collector. The junction of the collector and the load resistor is connected to one output terminal and the other end of the resistor is connected to a fixed, high voltage line derived from the oscillator circuit which is the second output terminal. A feedback amplifier is connected to the base of the transistor and one input of the amplifier is coupled to a tap of a potential divider coupled between one output terminal (CPI) and ground. The transistor is an off-the-shelf power transistor which is operated in class A with a current gain less than unity and at such a low maximum collector current that the risk of thermal runaway which would lead to secondary breakdown is avoided.

9 Claims, 6 Drawing Figures

AUTOMATIC BRIGHTNESS CONTROL CIRCUIT FOR A HIGH VOLTAGE ELECTRICAL POWER SUPPLY

The present invention relates to an electrical power supply arrangement for an electronic imaging tube employing a microchannel intensifier device. For convenience of description, such a tube will be referred to hereinafter as an image intensifier tube.

Such tubes may comprise an envelope in which there is arranged a fiber optic input window having a photocathode for providing an electronic image of the light impinging on the photocathode. The tube also includes a conical anode electrode for focusing the electron beam generated by the photocathode and inverting the electron image. A focus correction electrode is provided for focusing of the electron beam, a microchannel image intensifier plate is provided for amplifying the electronic image impinging on the entrance side thereof, and a fiber optic output window having a phosphor screen disposed opposite the exit side of the microchannel plate is provided for producing a visible image from the amplified electronic image leaving the microchannel plate.

A power supply for use with such an image intensifier tube is required to produce a number of substantially fixed D.C. voltages and a variable potential difference which is applied to the input and output electrodes of the microchannel plate. Generally the photocathode supply is minus 2.0 KV, 130 nA measured with respect to the input electrode of the microchannel plate, the conical anode supply is plus 1.0 KV, 10 nA measured with respect to the input electrode of the microchannel plate, the focus correction electrode supply is minus 1.0 KV, 10 nA measured with respect to the input electrode of the microchannel plate, the screen supply is plus 5 KV, 70 nA measured with respect to the output electrode of the microchannel plate, and across the microchannel plate a variable voltage of plus 200 to 1000 V into a 100 MΩ load is supplied.

The exact voltage supplied across the microchannel plate at any instant depends on the photometric gain required of the image intensifier tube. The potential difference between the output electrode of the microchannel plate and the phosphor screen is fixed while the potentials of the photocathode, the conical anode and the focus correction electrode float with the variations in the channel plate voltage. Generally the power supply is encapsulated to form a hollow cylindrical shell which fits closely on the cylindrical surface of the tube envelope to provide as compact an assembly as is possible having regard to the number of components used and the need to provide insulation between the high voltage outputs.

Various power supplies for use with image intensifier tubes are known of which two examples will be described with reference to the block schematic circuit diagram shown in FIG. 1 of the accompanying drawings.

The two examples of the known power supplies differ from each other in that the first example has asynchronous oscillators 10 and 26 while the second example has synchronized oscillators 10 and 26. The broken line 11 indicates a link between the oscillators. Apart from these differences the circuits are substantially the same.

In FIG. 1 the oscillator 10 is a high voltage oscillator which produces a fixed alternating output voltage on the order of 1 KV peak-to-peak. This voltage is used to provide the above-mentioned D.C. voltages for the photocathode, the conical anode, the focus correction electrode and the screen of the image intensifier tube 36. Generally these voltages are provided by a high voltage multiplier having outputs 14, 16, 20 and 22. However for the convenience of description each of these outputs is shown to be derived from its respective D.C. supply 13, 15, 19 and 21.

An automatic brightness control (ABC) circuit 24 is provided to control the oscillator 26 which produces a variable output alternating voltage. The ABC circuit 24 is necessary to maintain a constant brightness image on the screen over a wide range of input illumination levels. To this end, an ABC sense signal is derived from the 5 KV DC supply 21 on the line 32. The output of the oscillator 26 is connected to the channel plate supply 28 which supplies a variable D.C. voltage across the microchannel plate of the tube 36. The supply 28 is connected to terminal identified as channel plate input CPI and channel plate output CPO. The CPI is also connected to the D.C. supplies 13, 15 and 19 so that their outputs can float with the CPI voltage.

In the case of the first example which uses asynchronous oscillators 10 and 26, a problem arises because the output voltage of the oscillator 26 is variable. Due to the large inductance and stray capacitance in the secondary of the step-up transformer which controls the frequency of operation of the oscillator 26, when the output voltage changes, the frequency also changes causing harmonic beating and "pulling" between the oscillators 10 and 26. This beating produces an instability or flicker which is unacceptable to a viewer. While the harmonic beating and pulling between the oscillators 10 and 26 can be controlled, it is expensive to do so.

The problem of flicker is overcome by the second example in which the two oscillators 10 and 26 have the same frequency for all light levels. However in order to be able to operate within a reasonable performance specification it has been found that an expensive and specialized component selection is required in order to reduce the pulling of the two oscillators 10 and 26 which will consume excessive power if forced to operate at other than their natural frequency. Since batteries are used to supply current to the power supply, it is necessary that the power consumption of the image intensifier tube be kept to the minimum consistent with proper operation. Both of these known examples utilize a large number of components and consequently the encapsulated power supply is bulky.

SUMMARY OF THE INVENTION

It is an object of the present invention to provide a power supply for a high voltage image intensifier tube which provides good regulation, no flicker and has a small number of components.

According to the present invention there is provided a power supply arrangement for an image intensifier tube having a microchannel image intensifier plate. The power supply comprises an automatic brightness control (ABC) circuit for producing a variable voltage to be supplied to the microchannel image intensifier plate. The control circuit includes a series regulating circuit comprising a transistor operated in class A with current gain less than unity and at such a low maximum collector current that the risk of thermal runaway which would lead to secondary breakdown is avoided.

By virtue of the ABC circuit controlling such a series regulating circuit, a power supply can be constructed having a single oscillator. Consequently there will be no problems due to frequency interference due to oscillators beating or pulling. The overall number of components is reduced and apart from the transistor of the series regulating circuit no special component selection is necessary. Therefore not only is the cost reduced but the size of the encapsulated power supply is smaller.

In an embodiment of the ABC circuit a feedback amplifier is connected to the base of the transistor. The amplifier has two inputs, one for a reference voltage and a second for a voltage proportional to the screen current, and therefore proportional to its brightness, which is connected to the voltage multiplier. Gain setting means and automatic brightness control setting means may be connected to the feedback amplifier. By making the current paths in the ABC circuit direct current ones, the response time of the ABC circuit is sufficiently fast that no additional circuits are necessary to protect the tube from the effects of sudden flashes of bright light on the photocathode.

British Patent Specification No. 1,340,092 discloses in FIGS. 2 and 3 a channel plate image intensifier system having a single oscillator whose output is applied to a Cockroft-Walton multiplier. The screen current is monitored and is used to vary the light produced by a light emitting diode. These variations in light intensity vary the conductivity (or resistance) of a vacuum photodiode connected to the output electrode of the channel plate in order to vary the potential difference not only between the output electrode of the channel plate multiplier and the screen but also between the input and output electrodes of the channel plate multiplier; the potential differences across the tube and between the photocathode and the input electrode of the channel plate multiplier are fixed.

Such a regulation system is not only different from that of the present invention but also requires a low leakage high vacuum photocell of a size required by the constraints of the power supply. As far as is known, such a type of photocell if ever produced, has not been produced in quantity and therefore its manufacture would inherently be expensive because of the small numbers concerned.

Furthermore the modulation transfer function (M.T.F.), which is a measurement of loss of contrast, for the cited system can be effected adversely at higher spatial frequencies because of the change in focusing due to variations in voltage between the output electrode of the channel plate multiplier and the screen. In an embodiment of the present invention the output electrode/screen potential difference is maintained constant and hence the risk of changing the tube focusing is avoided. Furthermore in the embodiment of the present invention the voltages applied to the photocathode, conical anode and distortion corrector are allowed to float with the input electrode of the electron multiplier thus permitting the potential difference across the channel plate multiplier to be varied by varying its input electrode voltage without affecting the M.T.F. of the intensifier tube.

DESCRIPTION OF THE PREFERRED EMBODIMENTS

Figure 2:
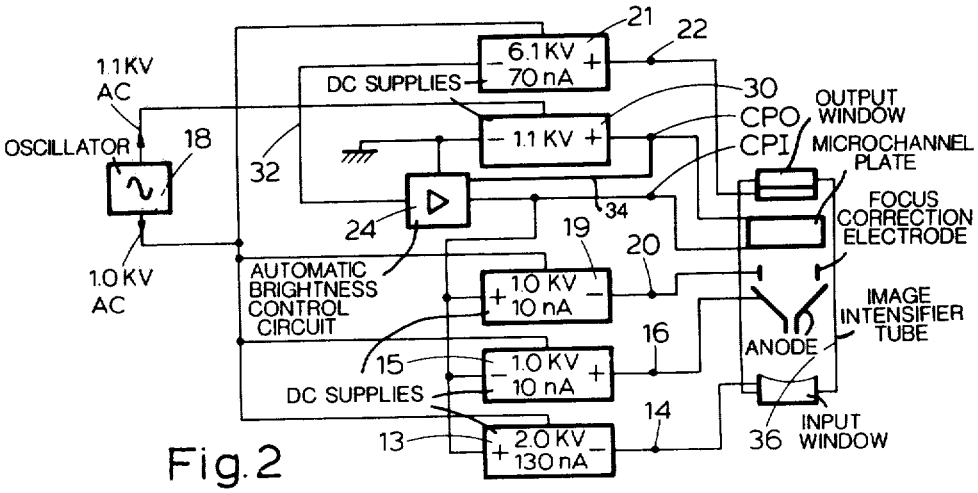
FIG. 2 is a block schematic circuit diagram of an image intensifier tube and a power supply made according to the present invention.

Referring to FIG. 2, the power supply comprises a single high voltage oscillator circuit 18 which produces a 1 KV peak-to-peak alternating voltage and a 1.1 KV peak-to-peak alternating voltage.

The 1.0 KV alternating voltage is used to derive the D.C. outputs of −2 KV, 130 nA; +1 KV, 10 nA; −1 KV, 10 nA and +6.1 KV 70 nA on the outputs 14, 16, 20 and 22, respectively. These voltages may be derived using a single high voltage multiplier or separate supplies. For convenience of description each of the outputs 14, 16, 20 and 22 will be shown as being connected to a respective supply 13, 15, 19 and 21.

The 1.1 KV peak-to-peak alternating current supply is connected to a +1.1 KV D.C. supply 30 which may be a voltage multiplier. The supply 30 is connected to the CPO terminal on the one hand and via a line 34 to the ABC circuit 24 on the other hand. An ABC sense signal is derived from the 6.1 KV supply 21 on the line 32. The output of the ABC circuit 24 is connected to the CPI terminals and to the DC supplies 13, 15 and 19 so that their output voltages can float with the voltage on the CPI output. The potential across the CPI and CPO outputs is a DC voltage which can vary between 200 and 1.1 KV with an output impedance of the order of 100 MΩ.

Figure 3:
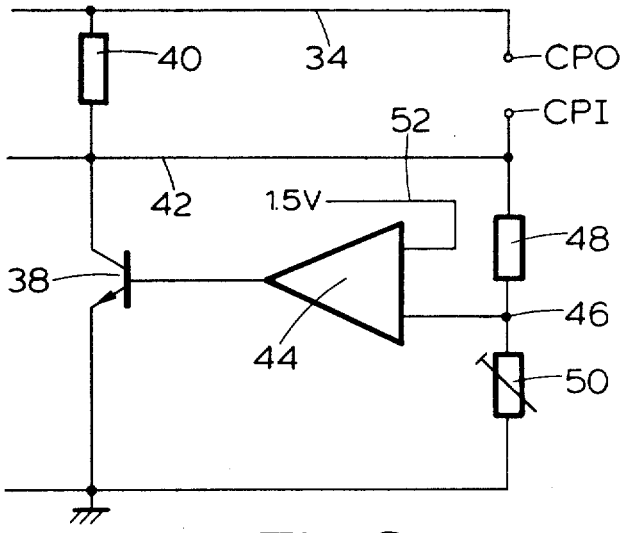
FIG. 3 is a schematic circuit diagram of an embodiment of a series regulator used in the ABC system of FIG. 2.

In order to provide a flicker-free image and good regulation the ABC circuit 24 comprises a series regulator circuit as shown schematically in FIG. 3. This series regulating circuit comprises an NPN power transistor 38, for example a selected BUX 87 or BUW 85 whose emitter is connected to ground and whose collector is connected via a load resistor 40 to a 1.1 KV line 34 which is also connected to the CPO terminal. The CPI terminal is connected to a line 42 to which the junction of the collector of the transistor 38 and the resistor 40 is connected. The output of a feedback amplifier 44 having a high input impedance is connected to the base of the transistor 38. One input of the amplifier 44 is connected to a tap 46 of a potential divider formed by a fixed high value resistor 48 and a presettable lower value resistor 50. The potential divider is connected between the line 42 and ground. A 1.5 V D.C. reference voltage line 52 is connected to a second input of the amplifier 44. In operation any variation in the voltage on the line 42 will cause the conductivity of the transistor 38 to be varied in such a manner that the voltage is quickly restored to that set.

The selection of the type of transistor 38 is important because it must be capable of controlling a voltage between collector and emitter ($V_{CE}$) of at least 900 V over the required temperature range (typically −60° C.

to +60° C.). The selection parameters are $V_{CE}$, size and leakage. Leakage is important because a high leakage current will affect the minimum voltage attainable at output CPI.

It has been found that there are no commercially available transistor of suitable size rated at $V_{CE} \geqq 900$ V under steady state conditions. A transistor such as BUX 87 is used in a so-called "switched-mode" power supply (pulsed operation), but the rating falls to 450 V under steady state (class A) conditions.

Transistor ratings are governed by the failure mechanisms within the transistor. For any specific transistor design there is a collector to emitter voltage at which the current carriers suddenly start to increase, thereby rapidly increasing the conductivity of the transistor. This mechanism is called "avalanche breakdown". Once the transistor is in the avalanche condition, the current passing through it can quickly rise, causing local over-heating of the semiconductor which causes catastrophic damage. This mechanism is called "secondary breakdown."

It has been found that by limiting the maximum current that can flow through the transistor by means of the resistor 40 it can be ensured that secondary breakdown does not occur. This permits the use of a transistor such as BUX 87 or BUW 85 up to its avalanche breakdown voltage. The voltage at which avalanche occurs is affected by the current gain and the base to emitter resistance. It is a feature of the circuits shown in FIGS. 3, 4 and 5 that the base-emitter resistance is $<1000\Omega$ when a high voltage appears across the transistor and the current gain is less than unity. Under these conditions the avalanche breakdown of the BUX 87 is greater then 1000 volts.

Hence a simple, compact and reliable power supply with a single oscillator can be built.

Figure 4:
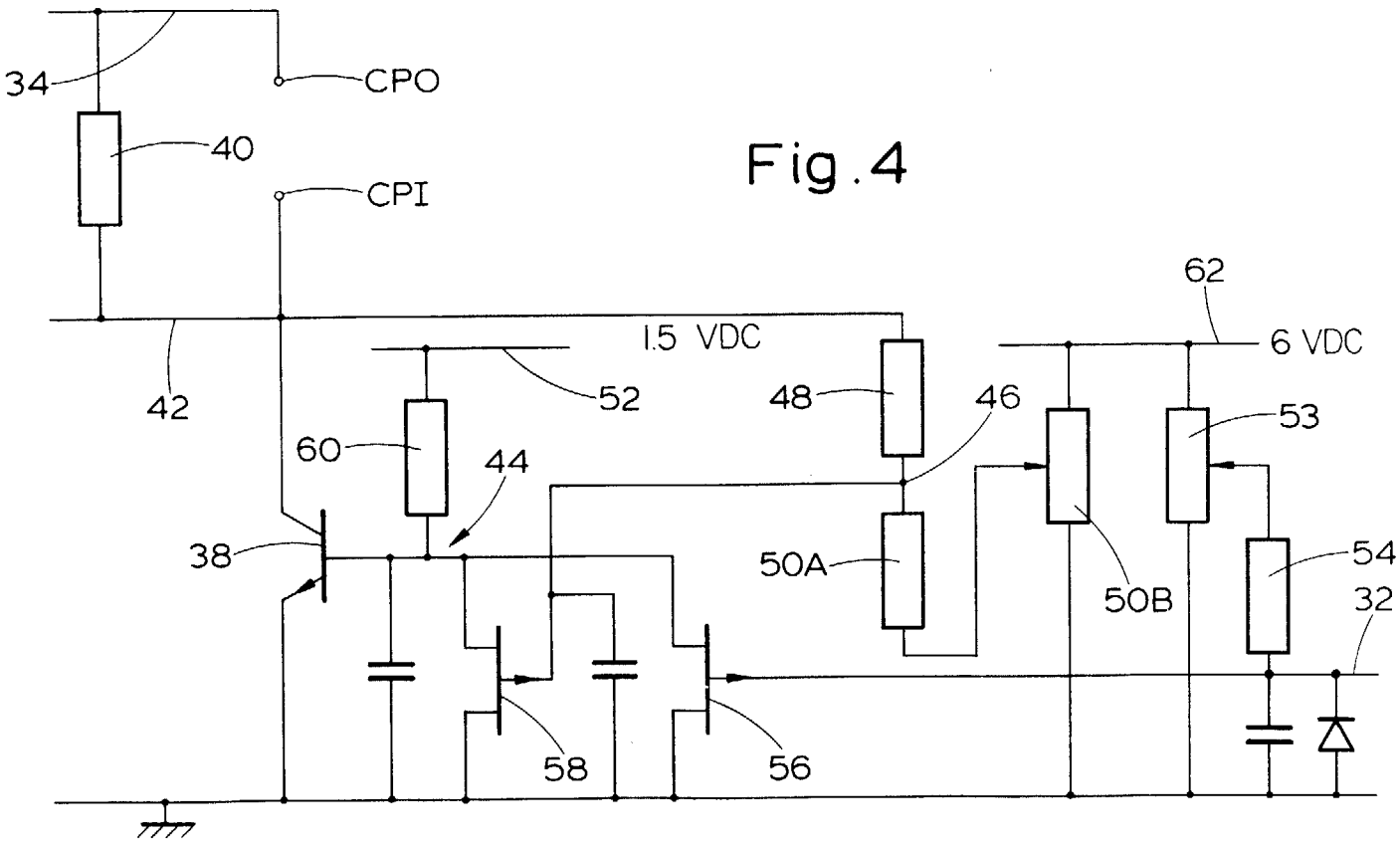
FIG. 4 is a simplified circuit diagram of the ABC system.

FIG. 4 shows one embodiment of the ABC circuit 24 including a series regulator. The values of the components selected depend on the particular microchannel plate being used. In this connection it should be borne in mind that the resistance of a channel plate varies with temperature, a typical resistance variation being from 400 MΩ to 3 GΩ.

The screen current (I screen) or ABC sense line 32 is connected to the tap of a potentiometer 53 via a resistor 54 and to the gate of an P-channel enhancement field effect transistor (FET) 56. The potentiometer 53 serves to adjust the operating level of the automatic brightness control circuit 24. The source-drain path of the FET 56 is connected between the base of the transistor 38 and ground. The feedback amplifier 44 is formed by another P-channel enhancement FET 58 whose source-drain path is connected between the base of the transistor 38 and ground. The reference voltage line 52 is connected to the amplifier 44 via a resistor 60.

The tap 46 of the potential divider is connected to the gate of the transistor 58. In this embodiment the potential divider comprises a high value resistor 48 connected between the line 42 and the tap 46 and a fixed value resistor 50A connected between the tap 46 and the wiper of a potentiometer 50B connected between a 6 V supply rail 62 and ground. The wiper of the potentiometer 50B is adjusted to set the maximum channel plate voltage.

The load resistor 40 is connected across the channel plate and is provided to standardize the load. The channel plate voltage can be varied between 200 and 1100 V.

In low light level operation the FET 56 will be turned off. As the light level increases, the FET 56 conduction increases reducing the voltage on the base of the transistor 38, which increases the voltage of line 42, which reduces the voltage across the channel plate hence reducing the photometric gain of the image intensifier tube and limiting the screen current and thus the screen brightness to a substantially constant level. The process is dynamic and because the system is DC operated the response to rapid changes of photocathode illumination is sufficiently fast that no special flash protection need be provided.

Figure 5:
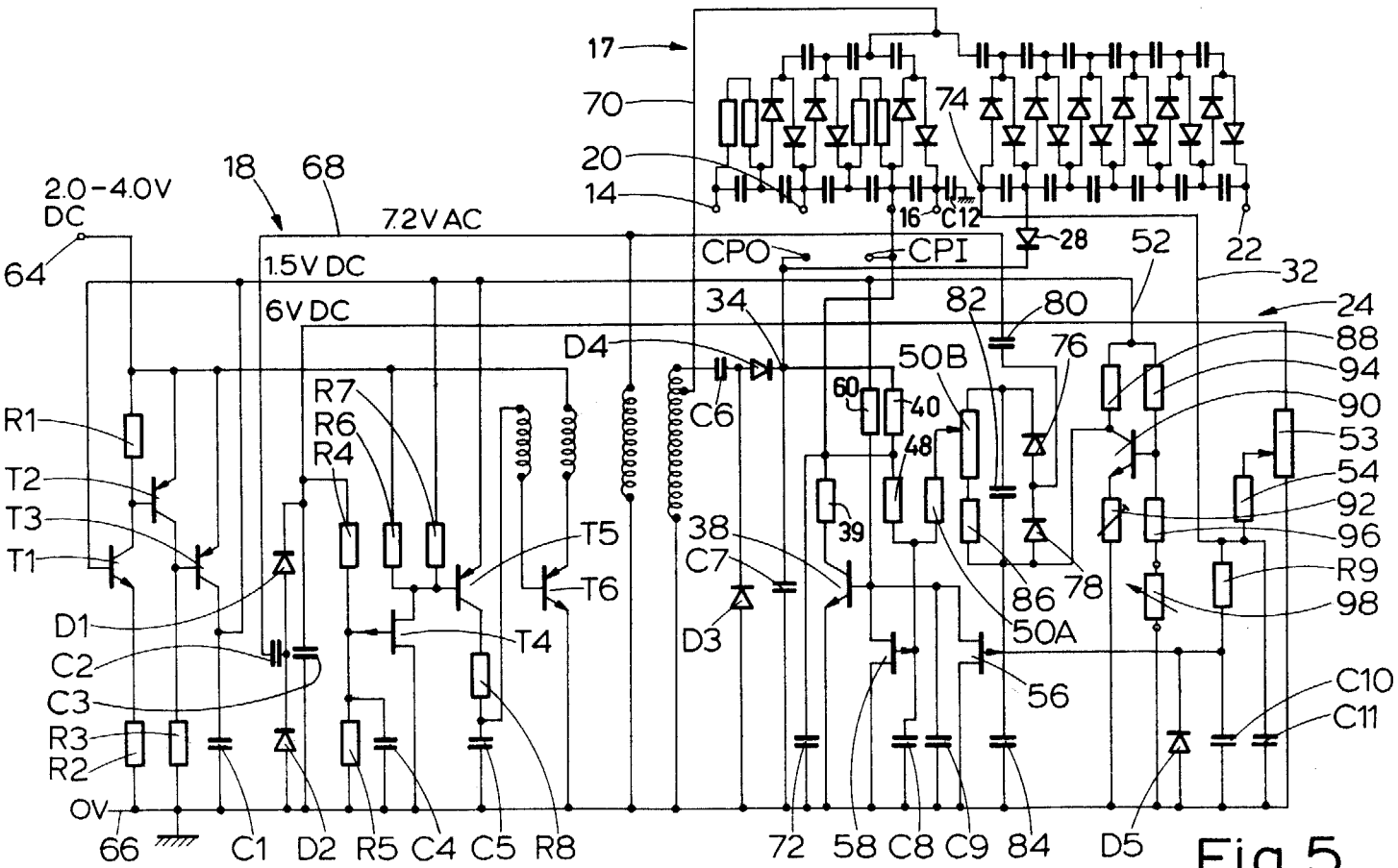
FIG. 5 is complete circuit diagram of a power supply unit made according to the present invention having a Cockroft Walton type series voltage multiplier.

FIG. 5 illustrates a circuit diagram of a complete power supply according to the present invention for use with an image intensifier tube. The power supply derives its energy from a 2.0 to 4.0 VDC supply, e.g. batteries, connected to the terminals 64 and 66 of the oscillator circuit 18 which is of known design and accordingly will not be described in detail. The oscillator circuit 18 provides a 1.5 V DC supply line 52, a 6 V DC supply line 62, a 7.2 V AC line 68, and a 1.1 KV DC channel plate supply line 34, all of which are connected to the ABC circuit 24 and a 1 KV peak-to-peak AC line 70. Line 70 is connected to a high voltage multiplier 17 from which the outputs 14, 16, 20 and 22 are derived. The line 34 is also connected to the CPO terminal.

Figure 1:
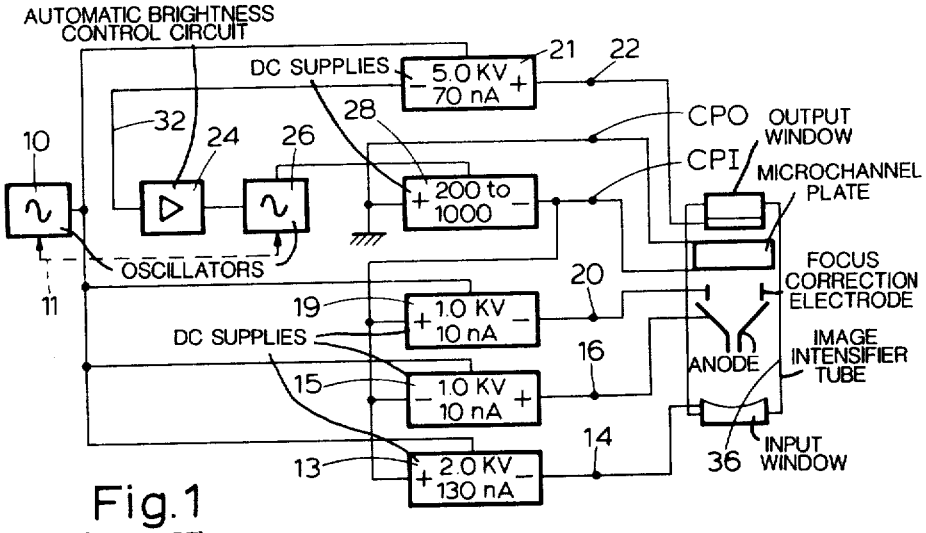
Fig.1 (PRIOR ART)
FIG. 1 is a schematic diagram of a known image intensifier tube and a power supply for it.
Figure 6:
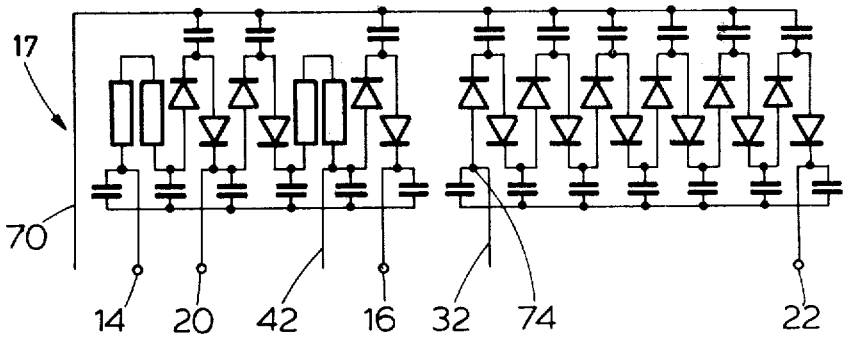
FIG. 6 shows an example of a parallel voltage multiplier which can be used in place of the series multiplier in FIG. 5.

The voltage multiplier 17 may comprise a Cockroft-Walton type series multiplier as shown in FIG. 5 or a parallel type multiplier as shown in FIG. 6. The operation of both types of multiplier is well known and accordingly in the interests of brevity will not be described. However it should be noted that the capacitor 72 (FIG. 5) connected in parallel with the collector-emitter path of the transistor 38 is not required when using the parallel type of multiplier shown in FIG. 6. The outputs of the multipliers are referenced as in FIGS. 1 and 2, namely 14, 16, 20 and 22 and the voltages thereon are substantially the same as those described with reference to FIG. 2.

The ABC circuit 24 is based on that shown in FIG. 4 and accordingly will not be described in detail. However it should be noted that the screen current line 32 is connected to an output 74 of the voltage multiplier 17.

A capacitor C12 is connected between a junction of the voltage multiplier 17 to which the output 16 is derived and ground in order to reduce or eliminate any ripple in the collector circuit of the series regulating transistor 38. Additionally in order to limit any transient currents flowing through the transistor 38, a resistor 39 is provided in the collector circuit of the transistor 38. The resistance value of the resistor 39 is low, typically 1 MΩ, compared with that of the load resistor 40, typically 200 MΩ.

The photometric gain level setting arrangement for the ABC circuit includes a full wave rectifier comprising diodes 76 and 78 and capacitors 80, 82 and 84 which are connected between the 7.2 V AC line 68 and ground. The output of the rectifier is applied to the ends of the potentiometer 50B. If necessary a negative temperature coefficient (NTC) thermistor 86 may be connected in the current path to one end of the potentiometer 50B to provide temperature compensation.

Additionally a series regulating network providing a customer gain control is connected to the anode of the diode 78. This series regulating network comprises a resistor 88, an NPN transistor 90 and a preset potentiometer 92 connected in series between the 1.5 line 52 and ground. The collector of the transistor is connected to the anode of the diode 78. The base of the transistor 90 is biased by a potential divider comprising fixed resistors 94 and 96 and a potentiometer 98 forming the customer gain control proper. The junction of the resistors 94 and 96 is connected to the base of the transistor 90. The potentiometer 92 is factory set to provide the necessary sensitivity of the customer gain control 98.

A diode 28 is connected between a junction of the voltage multiplier 17 and the CPO terminal in order to prevent an excess voltage from developing between the screen and the CPO on switching off, which voltage may damage the screen. In operation the diode 28 pulls down the screen voltage at substantially the same rate as the CPO voltage declines.

By way of example the illustrated circuit is designed to perform as follows:

| Input power 2.0 to 4.0 V D.C. at 60 mW max. outputs | | | |
|---|---|---|---|
| Terminal 14 | −2 KV | 130 nA | Measured with respect to CPI |
| Terminal 16 | +1 KV | 10 nA | |
| Terminal 20 | −1 KV | 10 nA | |
| Terminal 22 | +5 KV + $V_{30}$ | 70 nA | Measured with respect to CPO |

Across Terminals CPI and CPO +200 V to 1100 V (variable into 100 MΩ) Component values and types:

| | | |
|---|---|---|
| Oscillator circuit 18: | | |
| Transistor | T1 | BC 548 |
| Transistor | T2,T3,T5 | BC 558 |
| Transistor | T4 | 2N 3820 |
| Transistor | T6 | BC 548 |
| Diodes | D1, D2 | BAV 10 |
| Diodes | D3, D4 | BY 509 |
| Resistors | R1, R8 | 2K2 |
| Resistors | R2 | 3K3 |
| Resistors | R3 | 5K6 |
| Resistors | R4,R6,R7 | 100K |
| Resistors | R5 | Adjust on test |
| Capacitors | C1 | 100 n |
| Capacitors | C2,C3,C5 | 47 n |
| Capacitors | C4 | 1 nO |
| Capacitors | C6,C7 | 400 pF |
| High voltage multiplier 17 - series and parallel types | | |
| Resistors | | 100 M |
| Capacitors | | 400 pF |
| Diodes | | BY 509 |
| Capacitor C12 | | 400 pF |
| ABC circuit: | | |
| Transistor | 38 | BUX 87 or BUW 85 |
| Transistor | 56, 58 | 2N 3820 |
| Transistor | 90 | BC 548 |
| Diodes | 76,78 | BAV 10 |
| Diodes | D5 | BAS 11 |
| Resistors/Potentiometers | | |
| Resistors/Potentiometers | 39 | 100 M |
| Resistors/Potentiometers | 40 | 200 M |
| Resistors/Potentiometers | 48 | 3GO |
| Resistors/Potentiometers | 50A,54 | 10 M |
| Resistors/Potentiometers | 50B,53 | 100K |
| Resistors/Potentiometers | 88 | 15K |
| Resistors/Potentiometers | 92 | 500 |
| Resistors/Potentiometers | 94 | 30K |
| Resistors/Potentiometers | 96 | 12K |
| Resistors/Potentiometers | 98 | 10K |
| Resistors/Potentiometers | R9 | 1MO |
| Capacitors | 72 | 400 pF |
| | 80,82,84 | 47 n |
| | C8,9,10 and 11 | 1 nO |

Although one embodiment of the present invention has been described in detail it is to be understood that other embodiments may be constructed with different component values and types and with different supply and bias voltages.

I claim:

1. A high voltage power supply for an image intensifier tube having a microchannel image intensifier plate, said plate having an input end and an output end, said power supply having an automatic brightness control circuit for producing a variable voltage across the ends of the image intensifier plate to vary the brightness of the image intensifier tube in response to a source of a signal which is related to the brightness of the tube, said power supply comprising:

a high voltage oscillator having at least one high voltage output;

a voltage multiplier, having an input electrically connected to the output of the oscillator, said multiplier having at least one high voltage output which, in operation, is connected to one end of the image intensifier plate; and an automatic brightness control circuit comprising a series regulating circuit having a transistor operating in class A with a current gain less than unity and with such a low maximum collector current that the risk of thermal runaway which would lead to secondary breakdown is substantially zero, said transistor having an emitter, base, and collector, the emitter and collector being electrically connected in series with a load resistor between ground and the high voltage output of the multiplier, the base, in operation, being electrically connected to the source of the signal which is related to the brightness of the image intensifier tube, the output of the automatic brightness control circuit being taken at the electrical connection between the transistor and the load resistor, said output, in operation, being connected to the other end of the image intensifier plate.

2. A power supply as claimed in claim 1, characterized in that the series regulating circuit further comprises a feedback amplifier having first and second inputs and an output, the first input in operation being electrically connected to a reference potential, the second input being electrically connected, via a resistor, to the collector of the transistor, the output of the feedback amplifier being electrically connected to the base of the transistor.

3. A power supply as claimed in claim 2, characterized in that the load resistor has two terminals, one of which is electrically connected to the high voltage output of the multiplier, and the other of which is electrically connected to the transistor, the output of the power supply being taken across the load resistor.

4. A power supply as claimed in claim 3, characterized in that the automatic brightness control circuit has a photometric gain level, and the power supply further comprises means for setting the photometric gain level of the automatic brightness control circuit, said means being electrically connected to the first input of the feedback amplifier.

5. A power supply as claimed in claim 4, characterized in that the current paths in the automatic brightness control circuit are direct current paths.

6. A power supply as claimed in claim 3, characterized in that the power supply further comprises means for setting the automatic brightness control of the automatic brightness control circuit.

7. A power supply as claimed in claim 6, characterized in that the current paths in the automatic brightness control circuit are direct current paths.

8. A power supply as claimed in claim 3, characterized in that the voltage multiplier has a second voltage output which is electrically connected to the other terminal of the load resistor, the load resistor being electrically connected across the image intensifier plate.

9. A high voltage power supply for an image intensifier tube having a microchannel image intensifier plate, said plate having an input end and an output end, said power supply having an automatic brightness control circuit for producing a variable voltage across the ends of the image intensifier plate to vary the brightness of the image intensifier tube in response to a source of a signal which is related to the brightness of the tube, said power supply comprising:

means for generating a high voltage direct current signal which, in operation, is connected to one end of the image intensifier plate; and an automatic brightness control circuit comprising a series regulating circuit having a transistor operating in class A with a current gain less than unity and with such a low maximum collector current that the risk of thermal runaway which would lead to secondary breakdown is substantially zero, said transistor having an emitter, base, and collector, the emitter and collector being electrically connected in series with a load resistor between ground and the high voltage direct current signal, the base, in operation, being electrically connected to the source of the signal which is related to the brightness of the image intensifier tube, the output of the automatic brightness control circuit being taken at the electrical connection between the transistor and the load resistor, said output, in operation, being connected to the other end of the image intensifier plate.

* * * * *